United States Patent [19]

Misumi et al.

[11] 4,222,775

[45] Sep. 16, 1980

[54] BASE METAL PLATE MATERIALS FOR DIRECTLY HEATED OXIDE CATHODES

[75] Inventors: Akira Misumi; Masaharu Kumada, both of Mobara, Japan

[73] Assignee: Hitachi, Ltd., Japan

[21] Appl. No.: 966,610

[22] Filed: Dec. 5, 1978

[30] Foreign Application Priority Data

Mar. 31, 1978 [JP] Japan ..... 53-36782

[51] Int. Cl.[2] ..... C22C 19/03

[52] U.S. Cl. ..... 75/170; 148/32

[58] Field of Search ..... 75/170; 148/32, 32.5

[56] References Cited

U.S. PATENT DOCUMENTS 2,858,207 10/1958 Warin ..... 75/170

*Primary Examiner*—R. Dean

*Attorney, Agent, or Firm*—Craig & Antonelli

[57] ABSTRACT

A base metal plate material for a directly heated oxide cathode comprising nickel as a main component, 2.0 to 5.5 atomic percentage of rhenium, 7 atomic percentage or less of molybdenum, and at least one reducing agent can be used for producing quick operating type directly heated oxide cathodes showing no peeling of the oxide layer from the base metal plate and having excellently improved mechanical strength at high temperatures and specific electric resistance.

5 Claims, 1 Drawing Figure

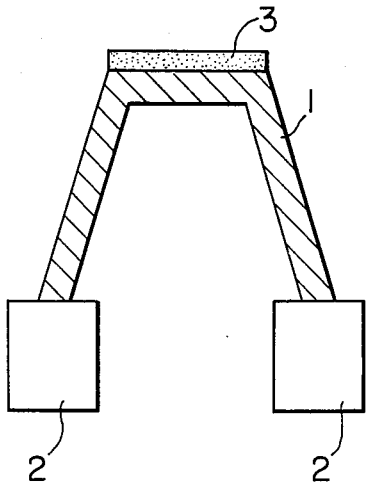
3
1
2
2

BASE METAL PLATE MATERIALS FOR DIRECTLY HEATED OXIDE CATHODES

This invention relates to a base metal plate material for a directly heated oxide cathode.

A prior art and the invention and the advantages of the latter will be described in detail with reference to the attached drawing which shows a sectional view of the principal part of an example of directly heated oxide cathodes.

As a cathode for a television picture tube, there has been mainly used in indirectly heated cathode wherein a time required for the appearance of an image from the beginning of receiving a television signal is shortened by always allowing flow of a preheating electric current through a heater even during a non-operation period and by raising a heater current value to a rating value at the time of receiving the television signal. But recently, from the viewpoint of saving energy, a quick operating type cathode which requires no preheating but a short time from the beginning of a heater current flow to the appearance of the image has been required. In the indirectly heated cathode, it generally requires about 20 seconds from the beginning of a heater current flow to the appearance of the image in the case of no flow of a preheating current. On the other hand, in the directly heated cathode wherein a so-called oxide for electron emission is directly coated on a heating element, the time required for the appearance of the image from the beginning of a heating current flow can be shortened to 1 to 2 seconds if properly designed. Such a cathode is suitable for the quick operating type cathode.

In the drawing, numeral 1 denotes a base which is heated by the supply of an electric current, numeral 2 denotes terminals for supplying the electric current, and numeral 3 denotes a so-called oxide. In order to improve the quick operating property of the cathode, it is necessary to use as the base 1 a material having high specific electric resistance so as to consume much electric energy in a small part of the electric current path. In order to control the temperature of the base made of such a material as mentioned above within a temperature range suitable for an oxide cathode, the base should have a form which has a longer periphery with respect to the cross-sectional area surrounded by the periphery. Therefore, the base is preferably made, for example, of a thin strip of such a material as mentioned above having a thickness of 100 μm or less, more preferably 60 μm or less. Thus, the material for the base should have sufficient mechanical strength at high temperatures in order to maintain the form having such a cross-section as mentioned above within the cathode operating temperature range. Moreover, the base material should have, as one of its important properties, the property of being suitable for causing sufficient electrons for a long period of time to be emitted from one or more so-called oxides such as barium oxide or a mixture of barium oxide and other oxides of alkaline earth metals, e.g. Ca, Sr, etc. coated on the surface of the base.

As materials which almost meet such conditions, alloys containing nickel as a main component together with either one or both of tungsten and molybdenum which are excellent in heat resistance and a trace amounts of one or more reducing agents have been used experimentally and experientially as a base metal for directly heated oxide cathodes (e.g. Japanese Patent Appln. Kokai (Laid-Open) Nos. 57771/77, 39054/78 and 39055/78). But when such alloys were used as the base, there arose many problems such as a large amount of a so-called interface layer due to tungsten or molybdenum being produced between the base and the oxide layer during the picture tube production process or the usage of the thus produced picture tube, and more often resulting in peeling of the oxide layer.

In order to solve such problems, there has been made a proposal of using as a base metal an alloy in which tungsten and molybdenum are replaced by rhenium. According to such a proposal, peeling of the oxide layer becomes practically immaterial because an interface layer due to rhenium is hardly produced. On the other hand, according to such an alloy containing rhenium, since solid solubility limit of rhenium in nickel is lower than that of tungsten or molybdenum, the resulting base metal plate cannot be fully sufficient in specific electric resistance and mechanical strength at high temperatures.

It is an object of the present invention to provide a base plate material for a quick operating type directly heated oxide cathode solving the various problems as mentioned above.

The present invention provides a base metal plate material for a directly heated oxide cathode which comprises nickel as a main component, 2.0 to 5.5 atomic percentage of rhenium, 7 atomic percentage or less of molybdenum, and a small amount of at least one reducing agent.

According to the base metal plate material for a directly heated oxide cathode of the present invention, since molybdenum which has higher solid solubility limit in nickel than rhenium is added in a limited amount to nickel together with rhenium which does not form an interface layer between the main component of nickel and the oxide layer, the formation of interface layers hardly takes place and the peeling of the oxide layer becomes immaterial. Moreover, the base metal plate can be improved in mechanical strength at high temperatures and specific electric resistance.

In the base metal plate material of the present invention, the amount of molybdenum should be 7 atomic percentage or less. If the amount of molybdenum is more than 7 atomic percentage, an interface layer due to molybdenum is formed remarkably. Further, if the amount of molybdenum is more than 7 atomic percentage and the amount of rhenium is 2 atomic percentage or more, rhenium and/or molybdenum is to be precipitated in the course of repeating temperature rise and cooling. If the amount of rhenium is less than 2 atomic percentage, specific electric eresistance and mechanical strength at high temperatures will become insufficient, while if the amount of rhenium is more than 5.5 atomic percentage, the precipitation will take place. Therefore, the amount of rhenium should be in the range of 2.0 to 5.5 atomic percentage and the amount of molybdenum should be 7 atomic percentage or less in order to prevent the precipitation of rhenium and/or molybdenum.

If the construction of the cathode does not require a base metal to have great mechanical strength at high temperatures and high electric resistance, an alloy of Ni-Re can be used as a base metal, but the use of such a Ni-Re alloy is not desirable considering other functions and performance. Further, a part of molybdenum can be replaced by tungsten upto 3 atomic percentage of tungsten in the alloy without forming interface layers due to molybdenum and tungsten and without peeling of the oxide layer. In such a case, since tungsten functions in such a manner as to maintain an electron emissive ability of the oxide cathode after the exhaustion of the reducing agent if contained, or from the beginning if the reducing agent is not contained, the presence of a proper amount of tungsten rather produces desirable results.

As the reducing agents, zirconium, magnesium, silicon, aluminium, and the like can be used. In the case of zirconium, it is preferable to use zirconium in an amount of 3.5 atomic percentage or less. If the amount is more than 3.5 atomic percentage, a eutectic having a lower melting point will be produced to lower mechanical strength at high temperatures. In the case of magnesium, silicon or aluminum, an impurity amount of such a reducing agent, corresponding to an amount contained in a conventional base metal for an oxide cathode as an impurity, is usually used.

When the base metal plate material of the present invention is used for producing directly heated oxide cathodes, peeling of the oxide layer hardly takes place, and there can be obtained directly heated oxide cathodes having sufficient mechanical strength at high temperatures and specific electric resistance.

The present invention will be explained in more detail by way of the following Example.

EXAMPLE

An alloy ingot containing 3.5 atomic percentage of rhenium, 4.5 atomic percentage of molybdenum, 0.3 atomic percentage of zirconium, and the remainder nickel was produced according to a standard power metallurgy process, and a base metal plate of 30 μm in thickness was formed by cold rolling while the ingot was subjected to vacuum annealing repeatedly. A ternary carbonate mixture of barium, strontium and calcium was coated on the base metal plate thus obtained and subjected to heat treatment at 1000° C. for about 100 hours under vacuum to convert the carbonates to the oxides. Adhesive strength of the oxide layer was examined under vacuum by scratching with a pin, and no peeling was produced.

For comparison, a base metal plate of 30 μm in thickness made of an alloy containing 11.5 atomic percentage of molybdenum, 0.3 atomic percentage of zirconium and the remainder nickel was formed and examined in the same manner as mentioned above. Adhesive strength of the oxide layer is considerably lowered.

The two samples mentioned above were taken out into the air and after removing the oxide layers, interface layers were analyzed by X-ray diffraction. In the Ni-Re-Mo-Zr alloy sample, only an interface layer due to zirconium was detected, whereas in interface layer due to molybdenum as well as an interface layer due to zirconium were detected in the Ni-Mo-Zr alloy sample.

The base metal plate made of the Ni-Re-Mo-Zr alloy was improved in mechanical strength at high temperatures and specific electric resistance comparing with a base metal plate of 30 μm in thickness made of an alloy containing 5 atomic percentage of rhenium, 0.3 atomic percentage of zirconium and the remainder nickel.

What is claimed is:

1. A base metal plate material for a directly heated oxide cathode which consists essentially of nickel as a main component, 2.0 to 5.5 atomic percent of rhenium, an amount of molybdenum sufficient to provide improved mechanical strength and electrical resistance at high temperature to the plate material up to not more than 7 atomic percent and at least one reducing agent selected from the group consisting of zirconium, magnesium, silicon and aluminum in an amount up to 3.5 atomic percent.

2. A base metal plate material according to claim 1, wherein the reducing agent is zirconium.

3. A base metal plate material according to claim 2, wherein the amount of zirconium is from 0.3 to 3.5 atomic percent.

4. A base metal plate material for a directly heated oxide cathode which consists essentially of nickel as a main component, 2.0 to 5.5 atomic percent of rhenium, an amount of molybdenum sufficient to provide improved mechanical strength and electrical resistance at high temperature to the plate material up to not more than 7 atomic percent, a part of molybdenum being replaced by tungsten up to 3 atomic percent of tungsten and at least one reducing agent selected from the group consisting of zirconium, magnesium, silicon and aluminum in an amount up to 3.5 atomic percent.

5. A base metal plate material according to claim 1, wherein the amount of molybdenum is 4.5 to 7 atomic percent.

* * * * *